United States Patent [19]

Marchildon et al.

[11] Patent Number: 4,954,302

[45] Date of Patent: Sep. 4, 1990

[54] PROCESS FOR CONTROLLING QUALITY OF YARNS

[75] Inventors: Ernest K. A. Marchildon; Douglas W. Muzyka; Michel M. Dumoulin, all of Kingston, Canada

[73] Assignee: Du Pont Canada, Inc., Mississauga, Canada

[21] Appl. No.: 238,507

[22] Filed: Aug. 31, 1988

[51] Int. Cl.[5] ..... D01F 1/02; D01F 6/58

[52] U.S. Cl. ..... 264/40.1; 264/40.6; 264/211

[58] Field of Search ..... 264/40.1, 40.3, 40.6, 264/40.7, 211

[56] References Cited

U.S. PATENT DOCUMENTS

| | | | |
|---|---|---|---|
| 3,992,239 | 11/1926 | Schroeder | 152/556 |
| 4,089,727 | 5/1978 | McLain | 156/169 |
| 4,369,934 | 1/1983 | Spies | 156/169 |
| 4,412,965 | 11/1983 | Thompson et al. | 264/257 |
| 4,675,378 | 6/1987 | Gibbon et al. | 528/272 |

FOREIGN PATENT DOCUMENTS

| | | | |
|---|---|---|---|
| 0245971 | 6/1969 | U.S.S.R. | 264/40.1 |

*Primary Examiner*—Hubert C. Lorin

[57] ABSTRACT

A process for controlling the relative viscosity of synthetic yarns during production thereof. At least three pressure measurements are taken at three spaced locations in a transfer line for carrying molten polymer to a spinneret. Temperature and throughput of polymer in said transfer line are measured. An estimated relative viscosity of yarn produced by employing a predetermined correlation between pressure drop, throughput, temperature and relative viscosity is then calculated. A meaningful operating condition in the melting zone is adjusted in response to deviations in the estimated relative viscosity of said yarn from a desired relative viscosity of said yarn.

4 Claims, 4 Drawing Sheets

PROCESS FOR CONTROLLING QUALITY OF YARNS

BACKGROUND OF THE INVENTION

This invention relates to a process for controlling the final quality of synthetic polymeric yarns during manufacture thereof.

Conventionally, the quality of yarn is determined by taking final product yarn samples and measuring chemical and physical properties of the samples in the laboratory. One yarn property that is measured is relative viscosity of the yarn. The term "relative viscosity" as used herein is defined as the viscosity of a dilute solution of the polymer divided by the viscosity of the solvent employed. For polyamides, the standard measurement of relative viscosity is the viscosity of an 8.4 wt. % solution of the polyamide in a 90 wt. % formic acid solution divided by the viscosity of the 90 wt. % formic acid.

The laboratory measurement of relative viscosity may be used to make adjustments to process conditions if the relative viscosity measurements differ from desired relative viscosity levels. The disadvantage with this process is that the lag time between the laboratory measurement and the adjustments is generally too long to provide meaningful, effective control of the process.

U.S. Pat. No. 4,675,378 discloses a process control scheme for controlling the quality of a polymer by controlling melt viscosity. Control is effected by continuously measuring the melt viscosity at the outlet of the polymerization vessel. Operating conditions in the polymerization vessel are adjusted when the viscosity at this point strays from the pre-established level. Melt viscosity is also controlled by periodically measuring viscosity just before the spinneret. When this viscosity level deviates from a pre-set level, the pre-established viscosity level in the reaction vessel is adjusted.

It is believed that this process is inaccurate since it suffers from several disadvantages. One disadvantage is that inferring melt viscosity at finite locations such as at the exit of the polymerization vessel or at some point before the spinneret does not take into account changes that may take place in the material before it is actually formed into fibres.

Another disadvantage is that the pressure measurements taken by the viscometers of this process are taken close together. Pressure drops measured over short distances may give a good representation of the polymer viscosity at a precise location However, such pressure drops are typically relatively small, therefore the measurement of these pressure drops is less precise.

One approach that has been taken is to increase pressure drop and thus improve the accuracy of such viscometers. This may be done either by diverging a side stream of polymer through a smaller orifice or by increasing the flow rate of this side stream through the use of an additional pumping means. This approach may cause a number of problems. For example, the higher shear rates created by these methods of increasing the pressure may induce an increase in temperature. Also, at the required shear rate, the polymer may exhibit non-newtonian flow properties instead of newtonian flow properties, which may effect the reliability of the results.

It is an object of the present invention to obviate or mitigate the above-mentioned disadvantages.

Accordingly, the invention provides a process for controlling the relative viscosity of synthetic yarns during production thereof comprising the steps of:

taking at least three pressure measurements at three spaced locations in a transfer line for carrying molten polymer to a spinneret;

measuring temperature and throughput of polymer in said transfer line;

calculating an estimated relative viscosity of yarn produced by employing a predetermined correlation between pressure drop, throughput, temperature and relative viscosity; and adjusting a meaningful operating condition in said melting zone in response to deviations in the estimated relative viscosity of said yarn from a desired relative viscosity of said yarn.

In another one of its aspects the invention provides a process for controlling the relative viscosity of synthetic yarns during production thereof comprising the steps of:

measuring the temperature and throughput of said yarn;

taking at least three pressure measurements at three spaced locations in a transfer line for carrying molten polymer to a spinneret;

calculating an estimated relative viscosity of yarn produced by employing the equation:

$$RV = \left[ \frac{(AdP1 + BdP2 + C)}{(THPT * Tcorr)} \right]^{(1/3.5)}$$

wherein:

RV = relative viscosity

THPT = throughput of polymer dP1 = P1 - P2 dP2 = P3 - P2

P1,P2,P3, pressure measurements taken $$Tcorr = \text{temperature correction factor} = \exp(-Ea/RT)$$

wherein:

Ea = activation energy for viscosity

R = ideal gas constant

T = absolute temperature of process and adjusting a meaningful operating condition in said melting zone in response to deviations in the estimated relative viscosity of said yarn from a desired relative viscosity of said yarn.

In another one of its aspects, the invention provides an apparatus for controlling the quality of yarn produced during manufacture thereof comprising:

at least three pressure sensors locatable within a transfer line for transferring molten polymer to a spinneret;

pressure measuring means and throughput measuring means associated with said transfer line for respectively measuring pressure and throughput of polymer therethrough;

calculation means for determining an estimated relative viscosity of said yarn employing a correlation between, temperature and throughput measurements made by said temperature measuring means and said throughput measuring means respectively, pressure measurements made by said pressure sensors and said estimated relative viscosity; and control means associated with said calculation means for adjusting a meaningful operating condition in said polymerization vessel when said estimated relative viscosity deviates substantially from a desired relative viscosity of said yarn.

In the present invention, the relative viscosity of the yarn is estimated using a correlation that takes into account changes in polymer relative viscosity that may take place before the spinneret. A meaningful operating condition is then adjusted in response to any deviations in relative viscosity. The present invention thus allows for relatively accurate control of yarn relative viscosity.

DESCRIPTION OF THE PREFERRED EMBODIMENTS

The present invention is particularly advantageous to use in yarn manufacturing processes wherein the polymer continues to react and/or change in the transfer line, since the present invention takes such changes into account by taking pressure measurements along the length of the transfer line and by extrapolating to determine RV of the yarn. The invention is most advantageously used with condensation polymers, which tend to undergo reaction with water in the transfer line. Most preferably, the polymer used is a polyamide or a polyester.

The meaningful operating condition controlled is preferably the water content of the polymer. In a unitary process, wherein polymer is made and then fed directly to the transfer line, the water content may be varied by employing a vacuum in the final polymerization vessel or finisher. In a split process, wherein premade polymer in the form of flakes or pellets is fed to an extruder and then travels to the transfer line, the water content may be varied by employing a vacuum in the extruder.

Preferably, the empirically determined constants in the correlation are calculated by measuring relative viscosity for known values of dP1 and dP2 and employing non-linear regression analysis. These constants are dependent on the flow properties of the polymer and the apparatus geometry. Thus if the apparatus geometry is changed, the constants may need to be recalculated. Also, these constants should be re-evaluated from time to time to ensure that internal apparatus geometry changes have not occurred due to gel formation.

The activation energy may be calculated empirically by varying temperature and measuring pressure variations or may be obtained from the literature.

The estimated relative viscosity is preferably determined at about one to ten minute intervals, and most preferably at about one minute intervals.

Preferred embodiments of the invention will be further described, by way of illustration only, with reference to the following figures in which.

Figure 1:
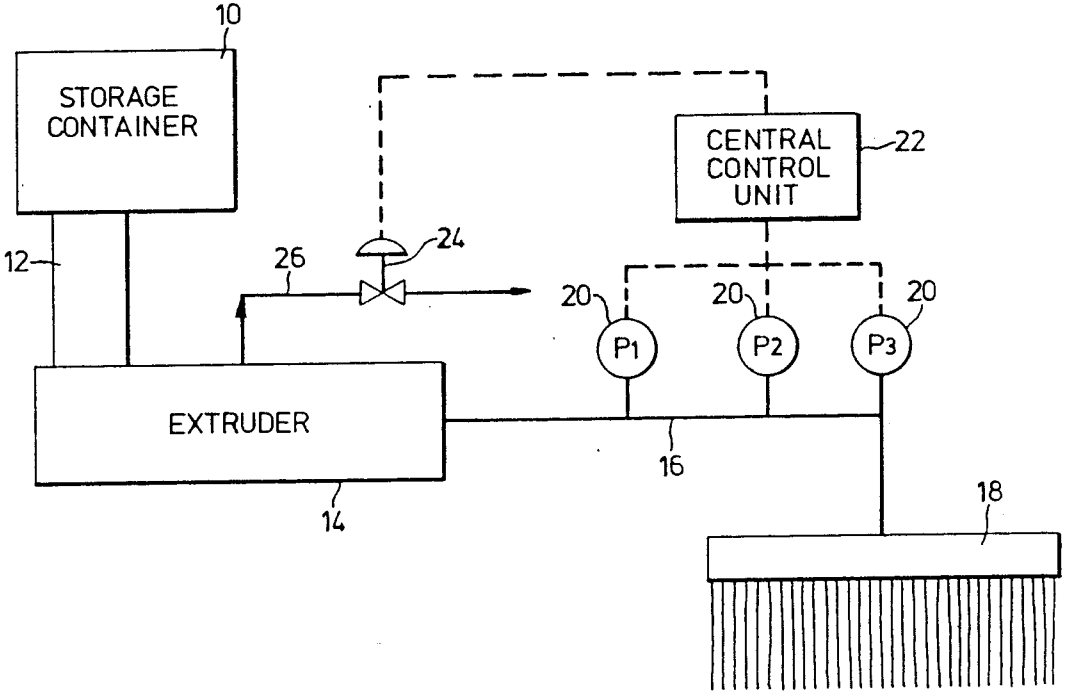
FIG. 1 is a schematic representation of a batch yarn manufacturing process employing a process control system.

Referring to FIG. 1, it can be seen that in a split process, nylon flake is removed from a storage container 10 and is introduced through an inlet 12 into an extruder 14. Polymer melt extruded from the extruder 14 is then passed through a transfer line 16 to a spinneret 18. Located in this transfer line 16 in spaced relation to one another are three pressure gauges 20. These gauges are each electrically connected to a central control unit 22 which in turn is electrically connected to a valve 24 in a vacuum line 26 for creating a vacuum in the extruder 14.

In operation, the pressure gauges 20 measure pressure in the transfer line 16 and relay this information to the central control unit 22. This unit calculates an estimated relative viscosity and compares it to a desired final product viscosity. If the estimated value deviates from the desired value by a substantial amount, the central control unit 22 causes the valve in the vacuum line 24 to change its setting to change the amount of vacuum and hence the amount of water drawn out of the extruder.

Figure 2:
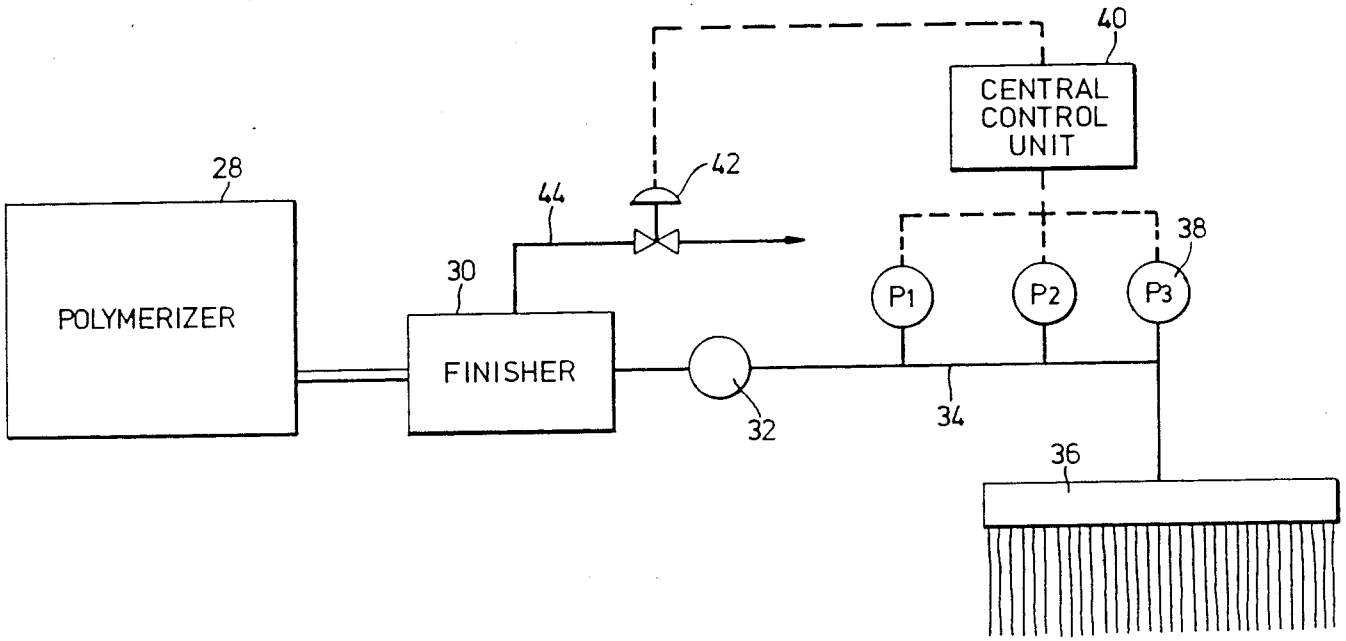
FIG. 2 is a schematic representation of a continuous yarn manufacturing process employing a process control system.

In FIG. 2, it can be seen that in a unitary process, polymer is formed in a polymerizer, which may be a single vessel 28 as shown or a series of polymerization vessels. The polymer so formed is then sent to a final polymerization vessel known as a finisher 30. Polymer exiting from the finisher 30 is pumped by a pump 32 through a transfer line 34 to a spinneret 36. Located in this transfer line in spaced relation to one another are three pressure gauges 38. These gauges 38 are each electrically connected to a central control unit 40 which in turn is electrically connected to a valve 42 in a vacuum line 44 for creating a vacuum in the finisher 30.

In operation, the pressure gauges 38 measure pressure in the transfer line 34 and relay this information to the central control unit 40. This unit calculates an estimated relative viscosity and compares it to a desired final product viscosity. If the estimated value deviates from the desired value by a substantial amount, the central control unit 40 causes the valve 42 in the vacuum line 44 to change its setting to change the amount of water drawn out of the finisher.

The development of the correlation for use in the present invention is outlined below.

Expression for the Relative Viscosity, RV

The dependence of the melt viscosity on molecular weight, MW, has the following form:

$$n_o = k\ MW^a \quad (1)$$

where a equals approximately 3.5 if MW is above a critical value and where $n_o$ is viscosity at a given reference temperature. For condensation polymers this value is quite low, of the order of about 5000 for the weight average molecular weight. The exponent a is therefore assumed to be 3.5 at all times.

The relation between RV and MW may be approximated by a linear relationship between RV and MW. This approximation is most accurate for RV values between 65 and 75, but will provide sufficiently accurate results for the range of RV values commonly associated with condensation polymers. It may therefore be assumed that RV and MW are proportional. From equation (1), it may be seen that RV depends on the melt viscosity raised to the power (1/3.5). The expression for melt viscosity has the following form $$n_o = dP/(Q * exp(-Ea/RT)) \quad (2)$$

wherein Q is volumetric flowrate and dP is the pressure gradient.

By incorporating the relationship between $M_w$ and RV into equation (1), substituting the expression for $n_o$ of equation (1) into equation (2), and substituting throughput, THPT, for flowrate Q in equation (2) the following expression for RV is obtained:

$$RV = \left[ \frac{dP}{(THPT * Tcorr)} \right]^{(1/3.5)} \quad (3)$$

wherein Tcorr is defined as a temperature correction factor and is equal to exp(−Ea/RT).

Pressure Drop at the Spinnerette

The required result of the calculations is RV at the spinneret. The term dP in expression (3) should thus represent the pressure gradient at the spinneret. It is necessary to use the three pressure measurements along the transfer line to extrapolate for the pressure gradient at the spinneret.

Figure 3:
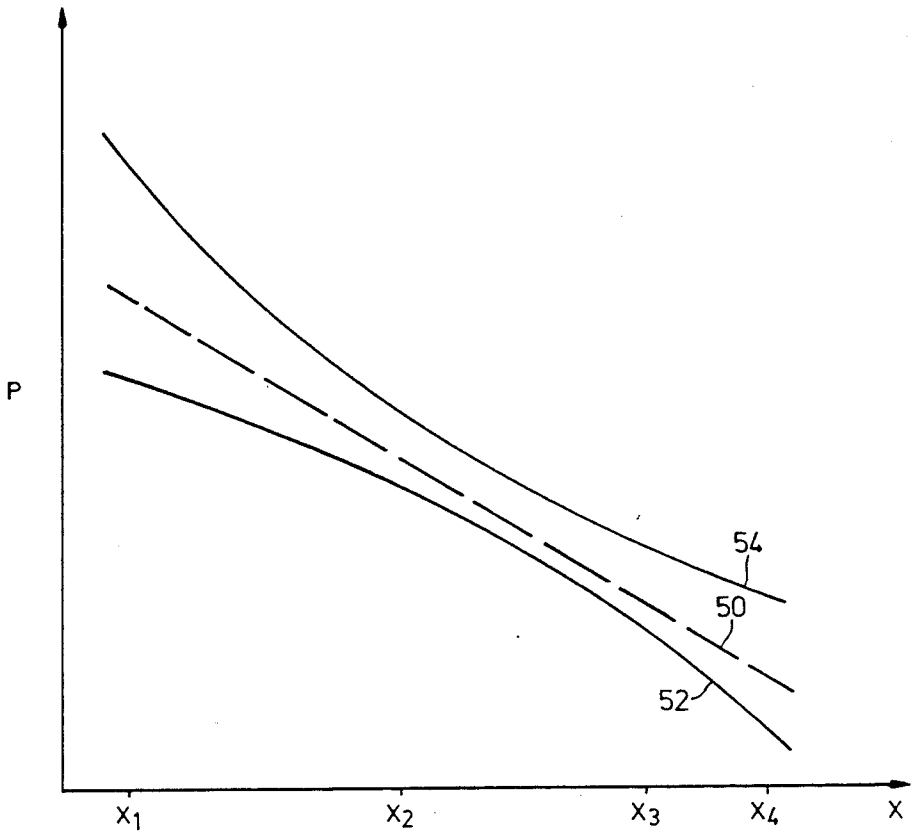
FIG. 3 is a graph of pressure versus distance along a transfer line.

It is possible that the polymer coming into the transfer line may not have reached a final equilibrium RV value. In that case, changes in the MW of the polymer will still take place in the transfer line. There are three possible cases, assuming no change in geometry of the transfer line, which are illustrated in FIG. 3. If there is no change in RV along the transfer line, the pressure gradient remains constant, as illustrated by curve 50. Changes in the pressure gradient may arise from polymerization (curve 52) or depolymerization (curve 54) in the transfer line. In all three cases, the pressure, P, in the transfer line may be described by the expression:

$$P = A'x^2 + B'x + C' \quad (4)$$

where x is the linear distance in the transfer line and A', B', and C' are coefficients. The linear distances at which the pressure measurements are made need to be known if the coefficients are to be determined.

However, due to the presence of numerous friction generating elements in the line (i.e. elbows, motionless mixers, . . . ), the equivalent linear distances required in equation (4) may not be accurately evaluated. Thus an equation for RV not related to the linear distance is required.

If $P_1$, $P_2$, and $P_3$ are the three measured pressures, the pressure drops between two measurement points are given by:

$$dP_1 = P_3 - P_2 = A'(x_3^2 - x_2^2) + B'(x_3 - x_2) \quad (5)$$

$$dP_2 = P_2 - P_1 = A'(x_2^2 - x_1^2) + B'(x_2 - x_1) \quad (6)$$

The coefficients A' and B' from equations (5) and (6) may then be defined in the following way:

$$A' = [a(P_3 - P_2) + b(P_2 - P_1)]/c \quad (7)$$

$$B' = [d(P_3 - P_2) + e(P_2 - P_1)]/f \quad (8)$$

where the coefficients a, b, c, d, e, and f are combinations of $x_1$, $x_2$, and $x_3$.

The pressure gradient at some position $x_4$ is obtained by differentiating equation (4):

$$\left.\frac{dP}{dx}\right|_{x4} = 2A'\,x4 + B' \quad (9)$$

$$= 2x4\,\frac{(adP_1 + bdP_2)}{c} + \frac{(ddP_1 + edP_2)}{f} \quad (10)$$

final expression

It has been shown in the last paragraph that the pressure gradient at some arbitrary position in the transfer line is proportional to a linear combination of two pressure drops. This allows for extrapolation of the pressure gradient at the spinning machine. The dP in equation (3) can therefore be replaced by a combination of $dP_1$ and $dP_2$, the two measured pressure drops, to obtain the final expression:

$$RV = \left[ \frac{A\,dP_1 + B\,dP_2 + C}{THPT * Tcorr} \right]^{(1/3.5)} \quad (11)$$

where A, B, and C are empirical constants. These constants account for the intrinsic resistance to flow of the material as well as for the geometry of the assembly and the location of pressure measurements. They are therefore fixed for a given polymer and a given transfer line configuration and may be determined empirically.

These constants may be determined by measuring RV in the lab for known pressure drops and employing non-linear regression.

EXAMPLE 1

A process set up similar to that shown in FIG. 1 was used. Polymer temperature and throughput were measured. The activation energy was evaluated by varying temperature and measuring pressure variations. The constants A, B, and C were evaluated by measuring RV in the lab for known pressure measurements. The results of this are reported in Table 1.

Figure 4:
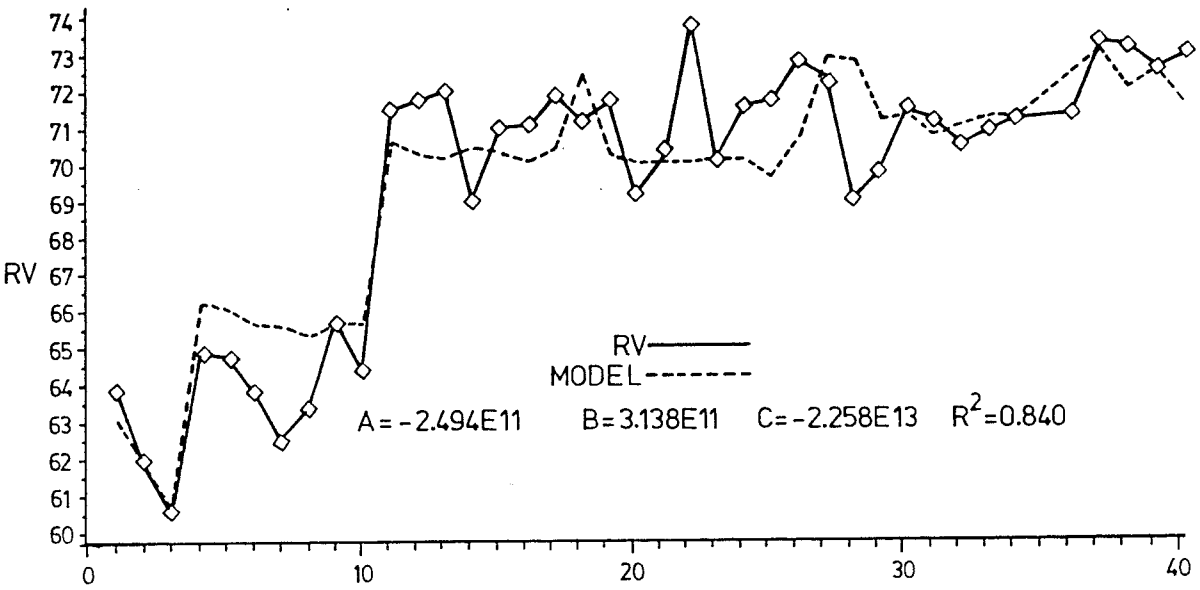
FIGS. 4 is a graph of relative viscosity (RV) vs. time.

The process was carried out for several days and RV was calculated daily using Equation (11). The calculated RV was compared to the measured RV. The results are shown in FIG. 4 which indicates that there is close agreement between calculated and measured RV.

TABLE 1

| PARAMETER | EXPERIMENTAL CONDITION OR RESULT |
|---|---|
| A | −2.494E11 |
| B | 3.138E11 |
| C | −2.258E13 |
| Throughput (kg/hr.) | 444–696 |
| Temperature (°C.) | 288.4–291.6 |
| dP1 (psi) | 126.5–264.2 |
| dP2 (psi) | 291.9–584.9 |

We claim:

1. A process for controlling the relative viscosity of synthetic yarns made from polymer during production thereof by controlling the water content of the polymer comprising the steps of:

taking at least three pressure measurements at at least three spaced locations in a transfer line for carrying polymer between a melting zone and a spinneret;

measuring temperature and throughput of polymer in said transfer line;

calculating an estimated relative viscosity of yarn produced by employing the equation:

$$RV = \left[ \frac{(AdP1 + BdP2 + C)}{(THPT * Tcorr)} \right]^{(1/3.5)}$$

wherein:

A, B and C=constants

RV=throughput of polymer

THPT=P1 -P2 dP1=P3 - P2

P1, P2, P3,=pressure measurement taken $Tcorr$ = temperature correction factor
= $\exp(-Ea/RT)$ wherein:

Ea=activation energy for viscosity

R=ideal gas constant

T=absolute temperature of process; and adjusting the water content of the polymer in response to deviations in the estimated relative viscosity of said yarn from a desired relative viscosity of said yarn.

2. The process of claim 1 wherein said constants A, B and C are calculated by measuring relative viscosity for known values of dP1 and dP2 and employing non-linear regression analysis.

3. The process of claim 1, wherein said yarn is made of a condensation polymer.

4. The process of claim 3 wherein said condensation polymer is selected from polyamide and polyester.

* * * * *